US006308350B1

(12) United States Patent
Marchionda

(10) Patent No.: US 6,308,350 B1
(45) Date of Patent: Oct. 30, 2001

(54) DRAIN TRAP FILTER ASSEMBLY

(75) Inventor: Anthony F Marchionda, Struthers, OH (US)

(73) Assignee: Anthony F. Marchionda, Jr., Struthers, OH (US)

( * ) Notice: Subject to any disclaimer, the term of this patent is extended or adjusted under 35 U.S.C. 154(b) by 0 days.

(21) Appl. No.: 09/708,950

(22) Filed: Nov. 9, 2000

(51) Int. Cl.[7] ..... E03C 1/12
(52) U.S. Cl. ..... 4/679; 4/292
(58) Field of Search ..... 4/679, 290, 292

(56) References Cited

U.S. PATENT DOCUMENTS

| | | | | |
|---|---|---|---|---|
| 1,817,376 | | 8/1931 | Izquierdo . | |
| 2,506,669 | * | 5/1950 | Heuacker | 4/292 |
| 3,982,289 | * | 9/1976 | Robbins | 4/292 |
| 4,051,042 | * | 9/1977 | Tullier et al. | 246/409 |
| 4,164,048 | | 8/1979 | Kampter et al. . | |
| 4,179,762 | | 12/1979 | Barnhardt et al. . | |
| 4,199,827 | * | 4/1980 | Taleja | 4/289 |
| 4,230,582 | * | 10/1980 | Tuleja | 4/292 X |
| 4,301,554 | | 11/1981 | Wojcicki . | |
| 4,949,406 | | 8/1990 | Canelli . | |
| 5,241,979 | | 9/1993 | Chang . | |
| 5,525,215 | | 6/1996 | Marchionda . | |

* cited by examiner

*Primary Examiner*—Charles E. Phillips
(74) *Attorney, Agent, or Firm*—Harpman & Harpman

(57) ABSTRACT

A drain trap having a U-shaped portion with a removable filter arranged for visual inspection and disposal. The filter extends from the cylindrical insert through an access extension from said base portion positioned within a cylindrical base portion via an access extension therefrom.

12 Claims, 4 Drawing Sheets

DRAIN TRAP FILTER ASSEMBLY

BACKGROUND OF THE INVENTION

1. Technical Field

This invention relates to drain traps in plumbing systems that provide water seal between the drain and the sanitary sewer system.

2. Description of Prior Art

In prior art drain traps, a variety of different designs can be seen having capture and removal features within to prevent lost objects from passing through the trap into the draining system and beyond. These devices also provide a filter mechanism to remove clogs from the trap. See for example U.S. Pat. Nos. 1,817,376, 4,164,048, 4,179,762, 4,301,554, 4,949,406, 5,421,979 and 5,525,215.

In U.S. Pat. No. 1,817,376 a drain strainer is disclosed having a sliding tray removably positioned within the upper portion of the drain trap.

In U.S. Pat. No. 4,164,048, a combination sink trap access port filter device is disclosed having a U-shaped drain configuration with an extension element having a filter positioned within with an access opening.

In U.S. Pat. No. 4,179,762 a trap is illustrated having a cylindrical base portion with a filter disk positioned within.

U.S. Pat. No. 4,301,554 is directed to a drain trap having a removable tray inserted through one opening with a plurality of upstanding fingers to trap and drain material in the water flow.

In U.S. Pat. No. 4,949,406 a sink trap filter assembly is disclosed in which a filter insert is positioned in the vertical portion of a J-shape drain having an access opening and a filter basket within.

In U.S. Pat. No. 5,241,979 a structure of an elbow pipe device is disclosed in which an elbow pipe has a access port on its lower portion on which a threaded extension is positioned in which a filter screen is positioned.

Finally, in applicant's own U.S. Pat. No. 5,525,215 discloses an improved structure for a drain trap having a filter arranged within for visual inspection and cleaning with a flow through inspection reservoir insert and filter cap extending downstream therefrom.

SUMMARY OF THE INVENTION

A drain trap assembly having a U-shaped body with a disposable filter positioned within, an optical access extension having a removable viewing cap and orientation cylindrical prefiltration reservoir with the disposable filter element extending downstream therefrom.

DESCRIPTION OF PREFERRED EMBODIMENT

Figure 1:
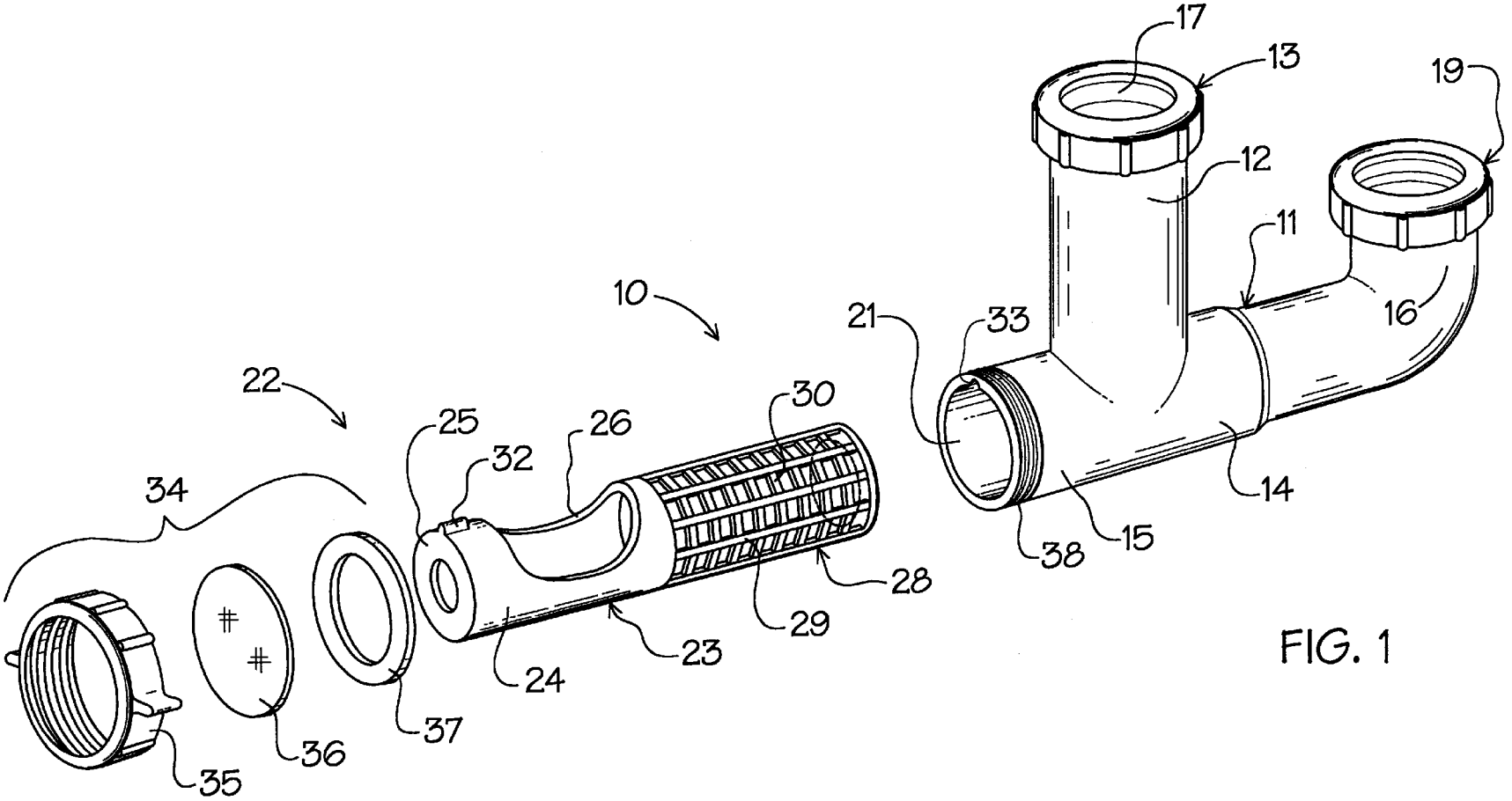
FIG. 1 is an exploded perspective view of the filter trap of the invention.
Figure 2:
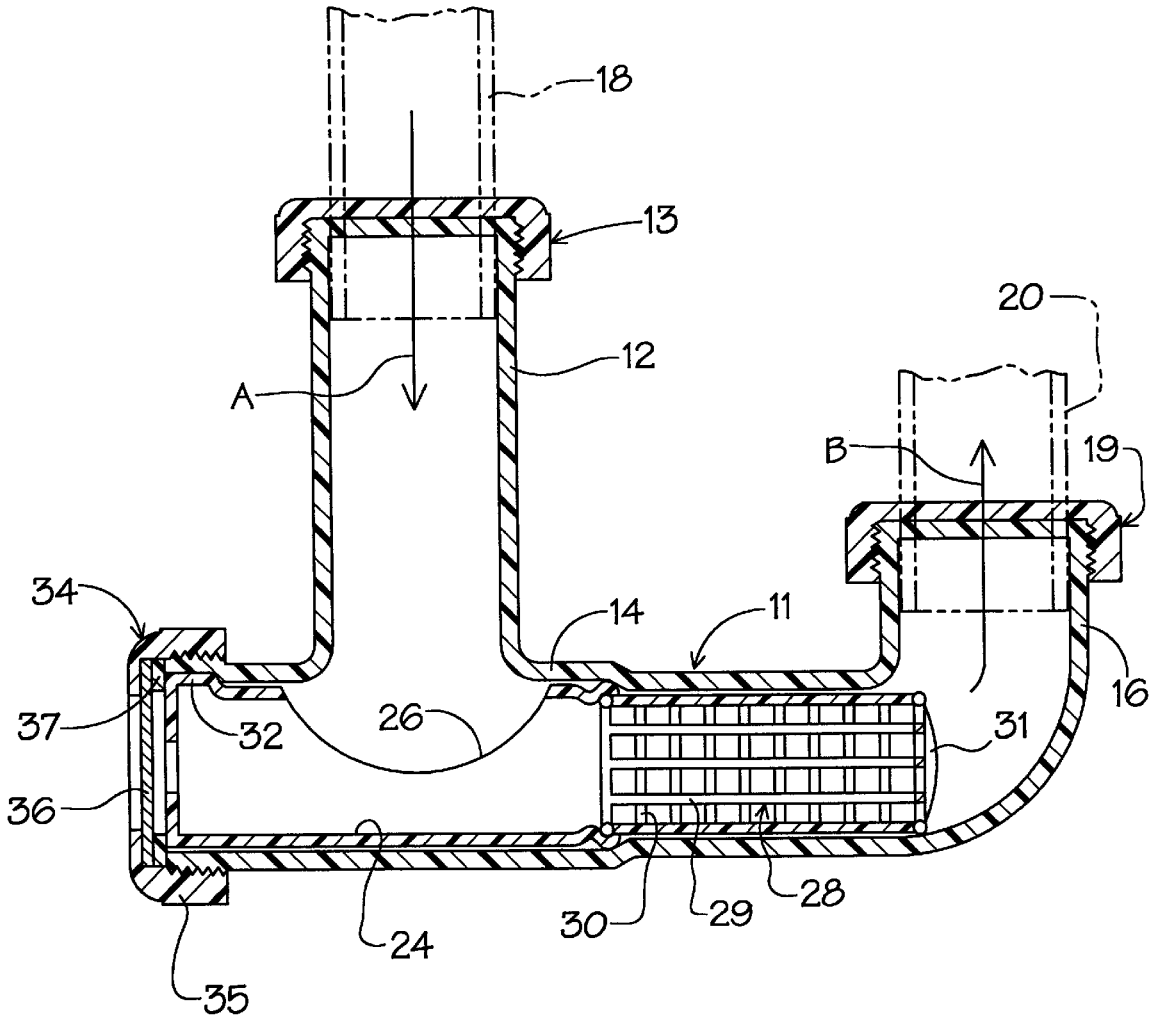
FIG. 2 is a cross-sectional view of the assembled filter trap of the invention.
Figure 4:
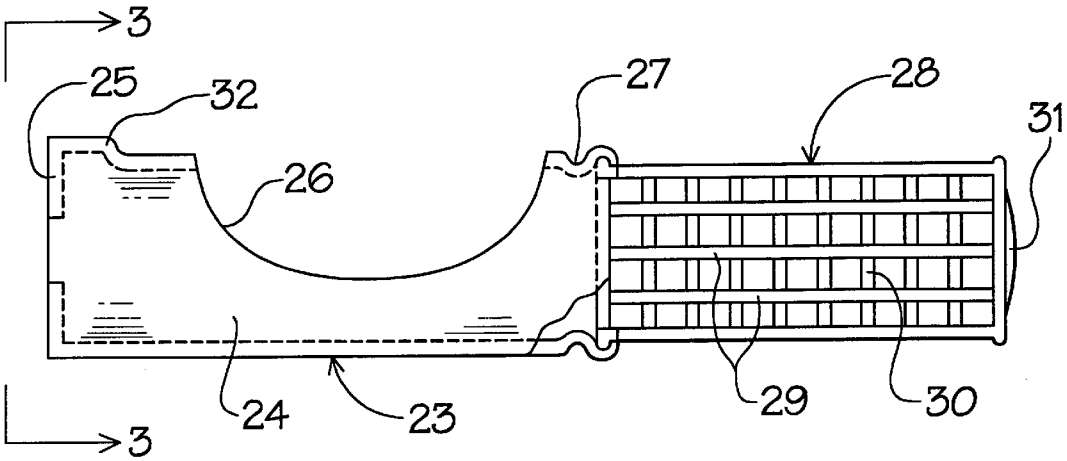
FIG. 4 is an enlarged side elevational view of the filter reservoir insert.
Figure 6:
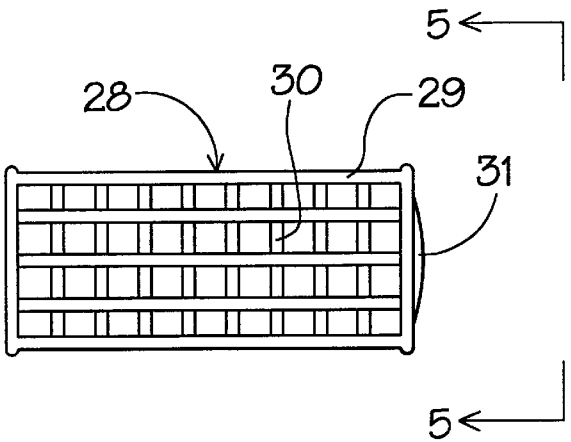
FIG. 6 is an enlarged side elevational view of a disposable filter insert portion.
Figure 5:
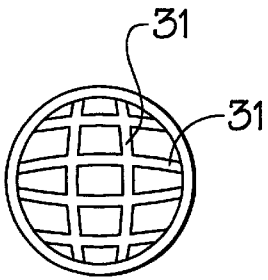
FIG. 5 is an end view on lines 5—5 of FIG. 6.

Referring to FIGS. 1 and 2 of the drawings, a drain trap assembly 10 can be seen having a U-shaped portion 11 comprising an upstanding leg portion 12 with a compression ring and gasket assembly 13 and a cylindrical base portion 14 having an extension 15 and a secondary upstanding return leg portion 16. The leg portion 12 is of a sufficient open dimension at 17 to accept the insertion of a drain line 18 from a plumbing fixture or the like (not shown), as will be well understood by those skilled in the art. The secondary upstanding return leg 16 is in spaced parallel relation to said leg portion 12 and has a ring and compression fitting assembly 19 to secure and seal a drain line 20 within.

The extension 15 provides an access portal at 21 for a filter and access viewing assembly 22 for removably positioning within a cylindrical base portion 14 of the U-shaped portion 11. The access and viewing assembly 22 is comprised of a filter and mounting cylindrical insert 23 having a main tubular body member 24 with an inturned apertured end 25. The body member 24 has an arcuate longitudinally extending notch within at 26 inwardly of its apertured end at 25. An annular mounting groove 27 is formed within the cylindrical body member 24 in oppositely disposed relation to said apertured end 25 defining a filter mounting access opening. A disposable filter basket 28, best seen in FIGS. 3–6 of the drawings has a plurality of longitudinally extending annularly spaced elements 29. A plurality of annular rings 30 in spaced longitudinal relation to one another intersects said respective elements 29 defining a cylindrical web wall. A plurality of contoured right angularly intersecting spaced rod elements 31 extend across one end of the cylindrical web 28 forming the basket configuration.

It will be evident from the above description that the tubular body member 24 can be formed from a porous material so as to promote the flow of fluid therethrough.

The filter basket 28 is removably secured within the annular mounting groove 27 and extends downstream into a portion of the secondary upstanding leg 16, best seen in FIG. 2 of the drawings. The tubular body member 24 has an upstanding alignment lug 32 extending therefrom adjacent its extended apertured end 25. A corresponding lug registration notch at 33 is formed within the wall of the access extension 15 which will be best seen in FIGS. 1 and 2 of the drawings. It will be evident from the above description that the alignment lug 32 will orient the tubular body member 24 so that the notch at 26 will always be aligned under the leg 12. A sealing end cap and view port assembly 33, best seen in FIGS. 1 and 2 of the drawings comprises a threaded annular compression ring 35 with a clear disk 36 within and an apertured resilient compression gasket 37 thereabout. The gasket 37 is engageable over the inturned end 25 which provides for the ring 35 a compression seal between the end cap and view port assembly 33 and the filter mounting cylindrical insert 24 within the base portion 15 when threadably engaged thereon at 38.

In use, liquids flow downwardly as indicated by directional arrow A through the drain line 18 into the drain trap 10 of the invention via the upstanding leg portion 12 and through the filter mounting cylindrical insert 23 and disposable filter basket 28. After passing through the above referred to filter configuration the liquid would typically flow upwardly and through the upstanding leg 16 and out via the outlet drain line 20 indicated by the directional flow arrow B.

It will be apparent that should a valuable item be inadvertently dropped into the drain trap 10 it will be retained within the trap 10 and be visible through the end cap view port assembly 33. Retrieval of the object can be achieved by removal of same and the cylindrical insert 23 with the attached disposable filter 28.

It will also be noted that once a clog develops within the drain trap 10 that the disposable filter basket 28 can be removed and discarded and replaced, restoring flow to the drain trap assembly.

Figure 7:
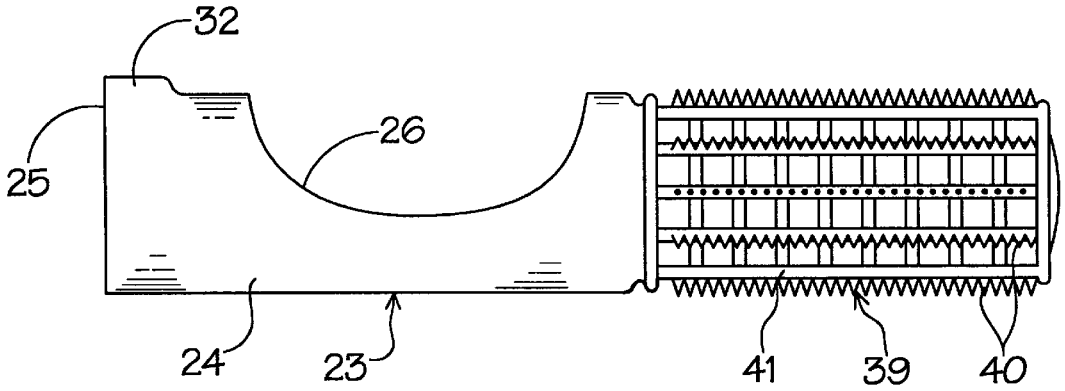
FIG. 7 is an enlarged side elevational view of an alternate form of the filter reservoir and insert.
Figure 8:
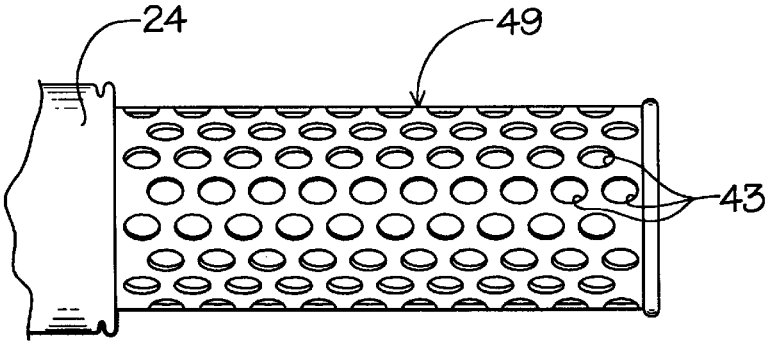
FIG. 8 is an enlarged partial side elevational view of an alternate filter insert configuration.
Figure 9:
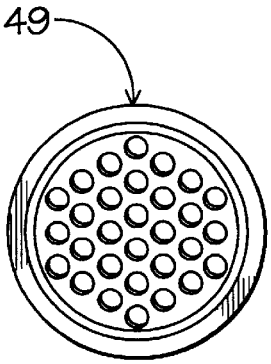
FIG. 9 is an end view on lines 9—9 of FIG. 8.

Referring now to FIGS. 7 and 8 of the drawings, two alternate forms of the drain basket 28 can be seen. In FIG. 7 of the drawings, a modified basket 39 is illustrated having the same basic structure as the preferred basket 28 with the addition of a plurality of fingers 40 formed along longitudinal basket elements 41. The multiple fingers 40 enhance the filtering ability of the basket 39 which will catch and retain entrained debris of various sizes and configuration.

In FIG. 8 of the drawings, a third alternate form of the filter basket is shown at 42 which has a plurality of apertures at 43 formed therein. This arrangement provides an enhanced filtering surface able to retain greater amounts of entrained material before the need to remove and clean or alternately discard as a disposable filter element. The hereinbefore described multiple filter basket configurations 28, 39 and 42 are preferably made of synthetic resin material with deformable properties that will allow for ease of removal and insertion into the cylindrical body member carrier 23 as hereinbefore described.

Figure 3:
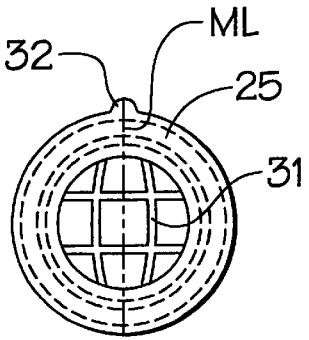
FIG. 3 is an enlarged end view on lines 3—3 of FIG. 4.

It will be noted that the filter baskets 28, 39 and 42 can be integral with the respective cylindrical insert 23 wherein the filter and cylindrical body member 24 can be of a disposable configuration being molded of synthetic resin material in a two-part molded elements as indicated by the broken mold line ML in FIG. 3 of the drawings.

It will be apparent to those skilled in the art that various changes and modifications may be made therein without departing from the spirit of the invention.

Therefore I claim:

1. A drain trap assembly comprising, a generally U-shaped hollow body assembly comprising a cylindrical base portion, an access extension extending therefrom, an upstanding inlet leg and outlet leg extending from said cylindrical base portion, a cylindrical insert removably positioned in said cylindrical base portion, said cylindrical insert having an elongated notch therein, an elongated filter basket removably secured and extending from said cylindrical insert, wherein mesas for removably securing said filter basket to said cylindrical insert comprises, and annular groove formed in a perimeter end annular edge of said cylindrical insert, a sealing cap removably secured to said access extension, an alignment lug extending from said cylindrical insert body, said lug registerable within a notch in said access extension.

2. The drain trap assembly set forth in claim 1 wherein said elongated notch in said cylindrical insert is positioned in said cylindrical base portion in vertical alignment with said respective upstanding inlet leg portions.

3. The drain trap assembly set forth in claim 1 wherein said cylindrical insert has an inturned apertured end adjacent said sealing cap.

4. The drain trap assembly set forth in claim 1 wherein said filter basket comprises a plurality of longitudinally extending annularly spaced elements and a plurality of longitudinally spaced annular rings intersecting said spaced elements and intersecting end insert elements extending across one of said rings.

5. The drain trap assembly set forth in claim 4 wherein said filter basket is molded of flexible synthetic resin material.

6. The drain trap assembly set forth in claim 4 wherein said filter basket further comprises a plurality of upstanding fingers extending along said respective elongated extending annular spaced elements.

7. The drain trap assembly set forth in claim 4 wherein said filter basket further comprises a cylindrical apertured wall.

8. The drain trap assembly set forth in claim 1 wherein said sealing end cap comprises, a compression ring, a disk within said compression ring, a resilient gasket engageable against said compression ring.

9. The drain trap assembly set forth in claim 1 wherein said filter basket is disposable.

10. The drain trap assembly set forth in claim 1 wherein said filter basket is of a smaller diameter than that of said cylindrical insert to allow fluid flow thereabout.

11. The drain trap assembly set forth in claim 1 wherein said filter basket positioned in said cylindrical base portion extends into partial vertical alignment with said respective upstanding outlet leg portion.

12. The drain trap assembly set forth in claim 1 wherein said U-shaped hollow body has an area of reduced annular dimension that extends from said cylindrical base portion through said upstanding outlet leg portion.

* * * * *